US009670757B2

(12) United States Patent
Wessel

(10) Patent No.: US 9,670,757 B2
(45) Date of Patent: Jun. 6, 2017

(54) DOWNHOLE PUMP FLUSHING SYSTEM AND METHOD OF USE

(71) Applicant: Warren Wessel, Red Deer (CA)

(72) Inventor: Warren Wessel, Red Deer (CA)

( * ) Notice: Subject to any disclaimer, the term of this patent is extended or adjusted under 35 U.S.C. 154(b) by 304 days.

(21) Appl. No.: 14/618,380

(22) Filed: Feb. 10, 2015

(65) Prior Publication Data

US 2016/0230517 A1 Aug. 11, 2016

(51) Int. Cl.

| | |
|---|---|
| ***E21B 43/12*** | (2006.01) |
| ***F04B 7/02*** | (2006.01) |
| ***F04B 53/04*** | (2006.01) |
| ***F04B 47/02*** | (2006.01) |

(52) U.S. Cl.

CPC ..... *E21B 43/12* (2013.01); *F04B 7/02* (2013.01); *F04B 47/02* (2013.01); *F04B 47/022* (2013.01); *F04B 53/04* (2013.01)

(58) Field of Classification Search

CPC .. E21B 43/12; F04B 7/02; F04B 47/02; F04B 47/022; F04B 53/04; F04B 53/162; F15B 21/041

USPC ..... 166/244.1; 417/431

See application file for complete search history.

(56) References Cited

U.S. PATENT DOCUMENTS

| | | | | |
|---|---|---|---|---|
| 4,573,529 A * | 3/1986 | Reinhardt | E21B 23/01 | 166/105 |
| 4,838,353 A | 6/1989 | Anders | | |
| 5,095,976 A | 3/1992 | Appleton | | |
| 5,141,411 A * | 8/1992 | Klaeger | F04B 53/1037 | 417/430 |
| 5,431,222 A * | 7/1995 | Bustamante | E21B 43/121 | 166/105 |
| 5,494,109 A | 2/1996 | Schmitt | | |
| 5,941,311 A | 8/1999 | Newton | | |
| 6,145,590 A | 11/2000 | Havard | | |
| 6,315,049 B1 | 11/2001 | Hickey et al. | | |

(Continued)

FOREIGN PATENT DOCUMENTS

| | | |
|---|---|---|
| WO | 2013100209 A2 | 7/2013 |
| WO | 2014025835 A2 | 2/2014 |

*Primary Examiner* — Taras P Bemko

(74) *Attorney, Agent, or Firm* — Davis & Bujold PLLC; Michael J. Bujold

(57) ABSTRACT

A downhole pump flushing system has a pump body defining an interior cavity, an inlet end, an outlet end and at least one flushing inlet. A lifting member is positioned within the interior cavity of the pump body for facilitating lifting of wellbore fluid. An injection mandrel in circumferentially engaging relation to an exterior surface of the pump body is provided such that it encompasses the at least one flushing inlet. The injection mandrel has an injection port fluidly connected to a fluid outlet port. The fluid outlet port is in fluid communication with the at least one flushing inlet of the pump body. An injection line is connected to the injection port of the injection mandrel and to a fluid supply. An annular channel is provided between the pump body and the injection mandrel adjacent to the at least one flushing inlet such that fluid is guided into the at least one flushing inlet from the fluid outlet port of the injection mandrel. A first sealing member and a second sealing member are provided in sealing engagement between the pump body and the injection mandrel such that a fluid tight seal is created above and below the at least one flushing inlet.

40 Claims, 5 Drawing Sheets

(56) References Cited

U.S. PATENT DOCUMENTS

| | | | |
|---|---|---|---|
| 8,689,879 | B2 | 4/2014 | Patel et al. |
| 8,701,780 | B2 | 4/2014 | Morton |
| 2009/0126924 | A1 | 5/2009 | Zarowny et al. |
| 2011/0265999 | A1 | 11/2011 | Cayford |
| 2012/0093663 | A1 | 4/2012 | Foster |
| 2014/0008078 | A1 | 1/2014 | Wade et al. |

* cited by examiner

DOWNHOLE PUMP FLUSHING SYSTEM AND METHOD OF USE

FIELD OF THE DISCLOSURE

The present application relates generally to a system and method for flushing a downhole pump for the purpose of preventing or removing, in whole or in part, accumulations of sand and other detritus materials from the pump.

BACKGROUND

This section provides background information to facilitate a better understanding of the various aspects of the invention. It should be understood that the statements in this section of this document are to be read in this light, and not as admissions of prior art.

During normal operation of a downhole pump within a well it is common to pump up a combination of water, oil, sand, gas and other detritus material such as wax, salt and hydrates. The sand and other detritus material are normally held in suspension within the oil and/or water as it is pumped. However, in the event that the pump stops, the sand and other detritus materials tend to settle within the pump. It is also common for slugs of material to enter the pump and clog it. The accumulation within the pump can cause wear on the pump and its sealing mechanisms, decrease efficiency of the pump, plug the pump and can ultimately cause the seizure of the pump.

Cleaning or flushing the accumulated sand and detritus material from a pump can be time consuming and expensive. It is also very difficult to remove the material from the internal workings of the pump. It may be necessary to remove production tubing and the pump to gain access to the accumulated material. This can be quite costly both with regards to man power for removing and replacing the pump and production tubing and the amount of time the well is not in service. Another method of cleaning or flushing the pump requires the use of a flush-by truck to facilitate flushing of the pump. The flush-by truck lifts the pump, removing the rotor from the stator or removing the plunger so that clean fluid may be pumped down the production tubing in an effort to remove the accumulated materials in the pump. However, this method is not particularly effective at removing accumulations from inside the pump. Again, there is a cost associated with this method of flushing the pump related to both the cost of the flush-by truck and its operation and the loss of production time for the well.

SUMMARY

There is provided a downhole pump flushing system that has a pump body defining an interior cavity and a lifting member positioned within the interior cavity for facilitating lifting of wellbore fluid. The pump body has an inlet end, an outlet end and at least one flushing inlet. The inlet end of the pump body has a standing check valve that allows fluid to enter the pump body. An injection mandrel is provided in circumferentially engaging relation to an exterior surface of the pump body and encompasses the at least one flushing inlet. The injection mandrel has an injection port fluidly connected to a fluid outlet port. The fluid outlet port is in fluid communication with the at least one flushing inlet of the pump body. A first end of an injection line is fluidly connected to the injection port of the injection mandrel and a second end of the injection line is fluidly connected to a fluid supply. An annular channel is created between the pump body and the injection mandrel adjacent to the at least one flushing inlet. The annular channel guides fluid from the fluid outlet port of the injection mandrel into the at least one flushing inlet on the pump body. A first sealing member and a second sealing member are provided in sealing engagement between the pump body and the injection mandrel such that a fluid tight seal is created above and below the at least one flushing inlet.

The at least one flushing inlet may be positioned proximate the inlet end of the pump body. By positioning the at least one flushing inlet in this location, the injection of flushing or treatment fluid into the pump body through the injection line allows the fluid to travel the entire length of the pump body from the inlet end to the outlet end. The at least one flushing inlet may also be angled towards the outlet end of the pump body. This can create a jetting action of flushing or treatment fluid that can be used to assist in the breaking up of accumulations of sand and other detritus materials. Where two or more flushing inlet are used, the flushing inlets may be positioned in parallel spaced relation to each other and perpendicular to a longitudinal axis of the pump body.

An injection check valve may be positioned within the injection line that permits the flow of flushing or treatment fluid towards the first end of the injection line. While the position of the check valve may be placed anywhere within the injection line, it may be beneficial for the injection check valve to be positioned adjacent the first end of the injection line such that it allows flow of fluid into the injection port of the injection mandrel. In the event of a break in the injection line, the positioning of the injection check valve adjacent the first end of the injection line will, in most cases, be able to prevent wellbore fluid from travelling up the broken injection line and into the wellbore between the casing and the production tubing. In addition to, or in the alternative, a second injection check valve may also be positioned within the injection port or fluid outlet port of the injection mandrel which permits the flow of fluid through the injection mandrel and into the at least one flushing inlet.

The pump body may be a pump barrel and the lifting member may be a plunger. The plunger is movable within the pump barrel from the inlet end to the outlet end to create an upstroke and from the outlet end to the inlet end to create a downstroke. The plunger has a traveling check valve that allows fluid to pass through the plunger from the inlet end of the pump barrel to the outlet end of the pump barrel. It may also be beneficial to include an upper check valve at the outlet end of the pump barrel to prevent fluid from re-entering the pump barrel after it has been expelled.

In a further embodiment, the downhole pump flushing system has a pump barrel defining an interior cavity. The pump barrel has an inlet end, an outlet end and at least one flushing inlet and the inlet end has a standing valve that allows fluid to enter the pump barrel. A plunger is positioned within the interior cavity of the pump barrel for facilitating lifting of wellbore fluid. The plunger is movable within the pump barrel from the inlet end to the outlet end to create an upstroke and from the outlet end to the inlet end to create a downstroke. The plunger has a traveling check valve that allows fluid to pass through the plunger from the inlet end of the pump barrel to the outlet end of the pump barrel. An injection mandrel is provided in circumferentially engaging relation to an exterior surface of the pump barrel such that it encompasses the at least one flushing inlet. The injection mandrel has an injection port fluidly connected to a fluid outlet port. The fluid outlet port is in fluid communication with the at least one flushing inlet of the pump barrel. An injection line has a first end and a second end. The first end of the injection line is fluidly connected to the injection port of the injection mandrel and the second end is fluidly connected to a fluid supply. An annular channel is created between the pump barrel and the injection mandrel adjacent to the at least one flushing inlet. The annular channel guides fluid from the fluid outlet port of the injection mandrel into the at least one flushing inlet on the pump barrel. A first sealing member and a second sealing member is provided in sealing engagement between the pump barrel and the injection mandrel such that a fluid tight seal is created above and below the at least one flushing inlet.

The at least one flushing inlet may be positioned proximate the inlet end of the pump barrel above the standing check valve. It is common for sand and other detritus material to accumulate at the standing check valve. By positioning the at least one flushing inlet in this location, the injection of flushing or treatment fluid into the pump barrel occurs at the site of sand and detritus material accumulation, there is no requirement for the fluid to travel through the pump barrel or production tubing to interact with the accumulations. The flushing or treatment fluid can interact with the sand and detritus material and carry it upwards through the pump barrel. The at least one flushing inlet may also be angled towards the outlet end of the pump barrel. This can create a jetting action of flushing or treatment fluid that can be used to assist in the breaking up of accumulations of sand and other detritus materials. Where two or more flushing inlet are used, the flushing inlets may be positioned in parallel spaced relation to each other and perpendicular to a longitudinal axis of the pump barrel.

An injection check valve may be positioned within the injection line that permits the flow of flushing or treatment fluid towards the first end of the injection line. While the position of the check valve may be placed anywhere within the injection line, it may be beneficial for the injection check valve to be positioned adjacent the first end of the injection line such that it allows the flow of fluid into the injection port of the injection mandrel. In the event of a break in the injection line, the positioning of the injection check valve adjacent the first end of the injection line will, in most cases, be able to prevent wellbore fluid from travelling up the broken injection line and into the wellbore between the casing and the production tubing. In addition to, or in the alternative, a second injection check valve may also be positioned within the injection port or fluid outlet port of the injection mandrel such that fluid is permitted to flow through the injection mandrel into the at least one flushing inlet.

The injection mandrel may have an engagement member that corresponds to a stop on the exterior of the pump barrel for positioning of the pump barrel in engagement with the injection mandrel. The engagement member on the injection mandrel may be an engagement shoulder.

The outlet end of the pump barrel may have an upper check valve that prevents fluid from re-entering the pump barrel after it has been expelled.

In a further embodiment, the downhole pump flushing system has a pump barrel that defines an interior cavity. The pump barrel has an inlet end, an outlet end and at least one flushing inlet positioned proximate the inlet end of the pump barrel. The inlet end of the pump barrel has a standing check valve that allows fluid to enter the pump barrel. A plunger is positioned within the interior cavity of the pump barrel for facilitating lifting of wellbore fluid. The plunger is movable within the pump barrel from the inlet end to the outlet end to create an upstroke and from the outlet end to the inlet end to create a downstroke. The plunger has a traveling check valve that allows fluid to pass through the plunger from the inlet end of the pump barrel to the outlet end of the pump barrel. An injection mandrel is provided in circumferentially engaging relation with an exterior surface of the pump barrel and it encompasses the at least one flushing inlet. The injection mandrel has an injection port fluidly connected to a fluid outlet port. The fluid outlet port is in fluid communication with the at least one flushing inlet of the pump barrel. The injection mandrel also has a first stop corresponding to a second stop on the exterior surface of the pump barrel for proper placement of the pump barrel within the injection mandrel. An injection line has a first end and a second end. The first end of the injection line is fluidly connected to the injection port of the injection mandrel and the second end is fluidly connected to a fluid supply. An injection check valve is positioned at the first end of the injection line such that fluid is permitted to flow to the injection port of the injection mandrel. An annular channel is created between the pump barrel and the injection mandrel adjacent to the at least one flushing inlet. The annular channel guides fluid from the fluid outlet port of the injection mandrel into the at least one flushing inlet on the pump barrel. A first sealing member and a second sealing member are provided in sealing engagement between the pump barrel and the injection mandrel such that a fluid tight seal is created above and below the at least one flushing inlet.

The at least one flushing inlet may be angled towards the outlet end of the pump barrel. This can create a jetting action of flushing or treatment fluid that can be used to assist in the breaking up of accumulations of sand and other detritus materials. Where two or more flushing inlet are used, the flushing inlets may be positioned in parallel spaced relation to each other and perpendicular to a longitudinal axis of the pump barrel.

In addition to the injection check valve positioned at the first end of the injection line, a second injection check valve may be positioned within the injection port or fluid outlet port of the injection mandrel such that fluid is permitted to flow through the injection mandrel into the at least one flushing inlet.

The outlet end of the pump barrel may have an upper check valve that prevents fluid from re-entering the pump barrel after it has been expelled.

There is further provided a method of flushing a downhole pump. The method includes the step of providing a pump. The pump has a pump body defining an interior cavity. The pump body has an inlet end, an outlet end and at least one flushing inlet. A lifting member is positioned within the interior cavity of the pump body for facilitating lifting of wellbore fluid. An injection mandrel is provided in circumferentially engaging relation to an exterior surface of the pump body such that it encompasses the at least one flushing inlet. The injection mandrel has an injection port fluidly connected to a fluid outlet port. The fluid outlet port is in fluid communication with the at least one flushing inlet of the pump body. An injection line has a first end and a second end. The first end of the injection line is fluidly connected to the injection port of the injection mandrel and the second end is fluidly connected to a fluid supply. An annular channel is created between the pump body and the injection mandrel adjacent to the at least one flushing inlet. The annular channel guides fluid from the fluid outlet port of the injection mandrel into the at least one flushing inlet on the pump body. A first sealing member and a second sealing member are provided in sealing engagement between the pump body and the injection mandrel such that a fluid tight seal is created above and below the at least one flushing inlet. An injection pump is provided for pumping fluids from the fluid supply through the injection line. Fluid agents are then injected into the second end of the injection line such that the fluid travels through the injection line and injection mandrel directly into the pump body through the at least one flushing inlet.

The at least one flushing inlet may be positioned proximate the inlet end of the pump body which allows the fluid agent to be injected directly into the pump body proximate to the inlet end. By positioning the at least one flushing inlet in this location, the injection of flushing or treatment fluid into the pump body through the injection line allows the fluid to travel the entire length of the pump body from the inlet end to the outlet end.

The injection of fluid agent may occur continuously, on a predetermined schedule or may occur at any time chosen by a well site operator. The injection or fluid agent may also occur after seizure of the lifting member within the pump body.

The method may also include addition steps. A controller and battery back-up may be provided. The controller and battery back-up are connected to the injection pump and the controller is capable of providing on and off signals to the injection pump. A signal can be sent from the controller to the injection pump to turn on utilizing power from the battery back-up in the event of a power failure. Fluid can then be injected into the second end of the injection line such that it travels through the injection line and injection mandrel directly into the pump body through the at least one flushing inlet. These steps are beneficial in the event of a power outage. When a downhole pump stops moving, sand and other detritus material often fall out of suspension and accumulate more quickly than when the pump is operating. By automatically starting the injection pump in the event of a power failure, fluid may be pumped directly into the pump to maintain the sand and detritus material in suspension. The fluid may also be used to flush the wellbore fluid upwards through the pump body to prevent accumulation of sand and detritus material.

Different types of flushing agents may be used based upon the type of detritus material that accumulates in the pump body and the type of treatment required. The use of a liquid flushing agent or a foam may be beneficial in flushing the pump body.

In a further embodiment, a method of flushing a downhole pump includes the step of providing a pump having a pump barrel and a plunger movable within the pump barrel. The pump barrel defines an interior cavity and has an inlet end, an outlet end and at least one flushing inlet positioned proximate the inlet end of the pump barrel. The inlet end of the pump barrel has a standing check valve that allows fluid to enter the pump barrel. The plunger is positioned within the interior cavity of the pump barrel for facilitating lifting of wellbore fluid. The plunger is movable within the pump barrel from the inlet end to the outlet end to create an upstroke and from the outlet end to the inlet end to create a downstroke. The plunger has a traveling check valve that allows fluid to pass through it from the inlet end of the pump barrel to the outlet end of the pump barrel. An injection mandrel is provided in circumferentially engaging relation with an exterior surface of the pump barrel such that it encompasses the at least one flushing inlet. The injection mandrel has an injection port fluidly connected to a fluid outlet port. The fluid outlet port is in fluid communication with the at least one flushing inlet of the pump barrel. The injection mandrel has a first stop corresponding to a second stop positioned on the exterior of the pump barrel for proper placement of the pump barrel within the injection mandrel. An injection line has a first end and a second end. The first end of the injection line is fluidly connected to the injection port of the injection mandrel and the second end is fluidly connected to a fluid supply. An injection check valve is positioned at the first end of the injection line such that fluid is permitted to flow to the injection port of the injection mandrel. An annular channel is created between the pump barrel and the injection mandrel adjacent to the at least one flushing inlet. The annular channel guides fluid from the fluid outlet port of the injection mandrel into the at least one flushing inlet on the pump barrel. A first sealing member and a second sealing member are provided in sealing engagement between the pump barrel and the injection mandrel such that a fluid tight seal is created above and below the at least one flushing inlet. An injection pump is provided for pumping fluids from the fluid supply through the injection line. Fluid agents are then injected into the second end of the injection line such that the fluid travels through the injection line and injection mandrel directly into the pump barrel through the at least one flushing inlet.

The injection of fluid agent may occur continuously, on a predetermined schedule or may occur at any time chosen by a well site operator. The injection of fluid agent may also occur after seizure of the plunger within the pump barrel.

The method may also include addition steps. A controller and battery back-up may be provided. The controller and battery back-up are connected to the injection pump and the controller is capable of providing on and off signals to the injection pump. A signal can be sent from the controller to the injection pump to turn on utilizing power from the battery back-up in the event of a power failure. Fluid can then be injected into the second end of the injection line such that it travels through the injection line and injection mandrel directly into the pump barrel through the at least one flushing inlet. These steps are beneficial in the event of a power outage. When a downhole pump stops moving, sand and other detritus material often fall out of suspension and accumulate more quickly than when the pump is operating. By automatically starting the injection pump in the event of a power failure, fluid may be pumped directly into the pump to maintain the sand and detritus material in suspension. The fluid may also be used to flush the wellbore fluid upwards through the pump body to prevent accumulation of sand and detritus material.

Different types of flushing agents may be used based upon the type of detritus material that accumulates in the pump body and the type of treatment required. The use of a liquid flushing agent or a foam may be beneficial in flushing the pump body.

BRIEF DESCRIPTION OF THE DRAWINGS

These and other features will become more apparent from the following description in which references are made to the following drawings, in which numerical references denote like parts. The drawings are for the purpose of illustration only and are not intended to in any way limit the scope of the invention to the particular embodiments shown.

DETAILED DESCRIPTION OF THE PREFERRED EMBODIMENTS

Figure 1:
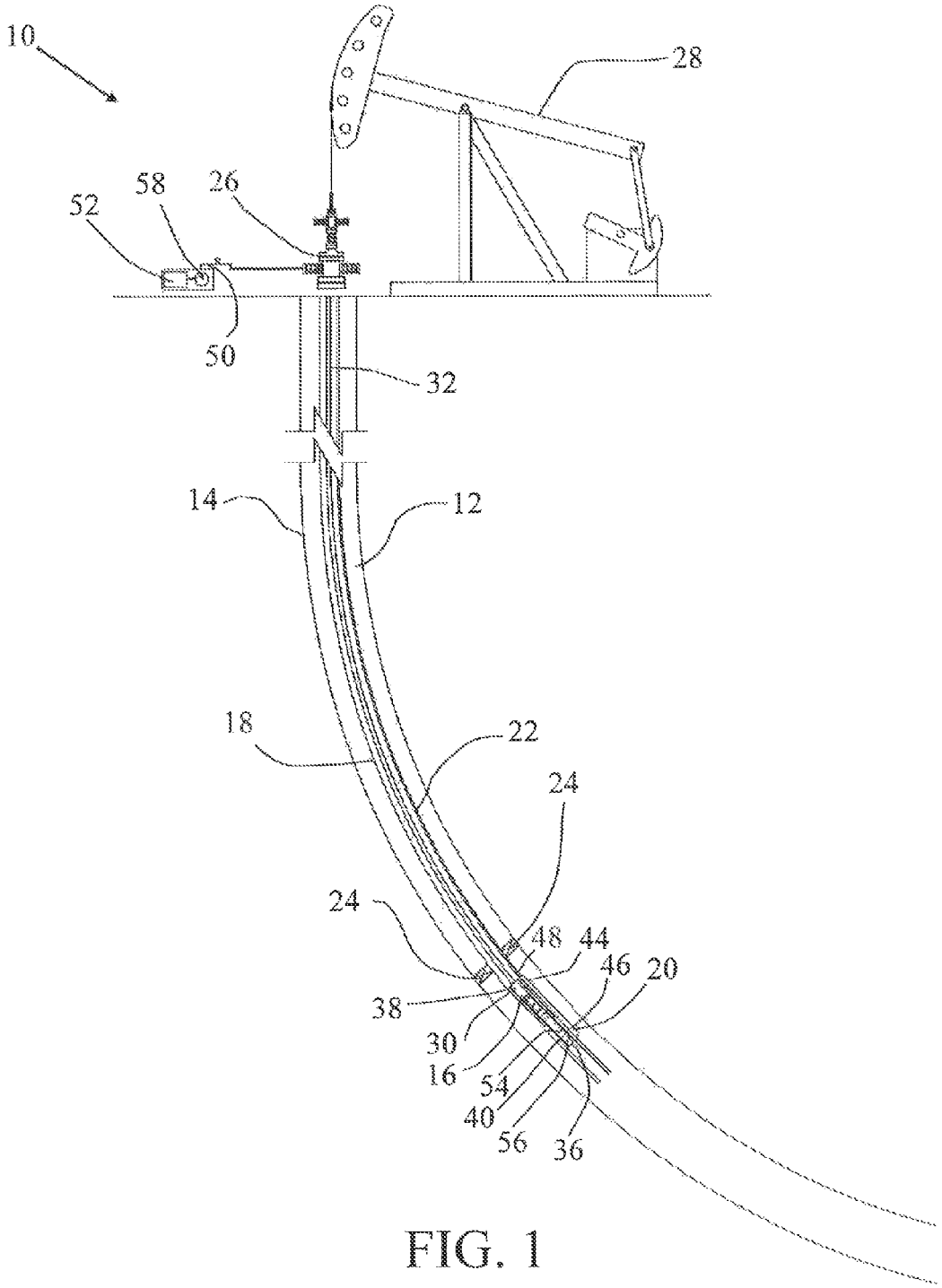
FIG. 1 is a schematic representation of a typical well site with the downhole pump flushing system installed.

General Overview of the Downhole Pump Flushing System:

A general overview of the downhole pump flushing system, generally identified by reference numeral 10, as used at a typical well site will now be described with reference to FIG. 1.

Referring to FIG. 1, at a typical well site, there is at least one wellbore 12. As a part of completion, wellbore 12 has a casing 14 made of cement and perforations, not shown, are made in casing 14 using a perforation gun or directional explosions to allow wellbore fluids to flow into casing 14. The downhole pump 16, production tubing 18, injection mandrel 20 and injection line 22, such as capillary tubing, are run down into casing 14 and production tubing 18 is anchored in place by anchors 24 or other conventional means. It will be understood by a person skilled in the art that anchors 24 may be positioned in various locations or may not be required. The positioning of anchors 24, or the decision not to use them, should be based upon current practices in downhole pumping. Downhole pump 16 may be any type of pump known by a person skilled in the art for use in downhole operations and may include, but is not limited to, plunger pumps, progressive cavity pumps and electric submersible pumps.

A production tank, not shown, is often provided for storage of the wellbore fluid that is produced from wellbore 12. In addition to the production tank, or in the alternative, a pipe line, not shown, for delivering the produced wellbore fluid to a treatment facility or to customer's may also be present. A blow out preventer 26 may also be included on the wellbore 12. A pump jack 28 is commonly provided for creating lift when using downhole pump 16. Power to pump jack 28 is supplied by conventional means.

The flushing fluid is often stored in supply tanks 52 and multiple fluid supply tanks may be provided to allow for treatment of pump 16 using different types of flushing or treatment fluids. While fluid supply 52 may be stored on site, it is also a possibility that a truck may transport flushing or treatment fluid to the well site as needed. An injection pump 58 is provided which allows fluid to be pumped from fluid supply 52 down through injection line 22 to downhole pump 16. Injection pump 58 can be set up so that it can draw from different fluid supplies using a controller and appropriate sensors, not shown, or pump 16 may be manually connected to specific fluid supplies 52 as needed. A person of skill will understand what types of controllers and sensors are best suited for each wellbore. The pumping of flushing and treatment fluids into downhole pump 16 may be completed by either automated or manual means.

Downhole pump 16 is made up of a pump body 30 and a lifting member, not shown, positioned within an interior cavity, not shown, of pump body 30 for facilitating lifting of wellbore fluid. The lifting member is attached to a polished rod 32 which is connected to pump jack 28. Pump body 30 has an inlet end 36, an outlet end 38 and at least one flushing inlet 40. Injection mandrel 20 is positioned in circumferentially engaging relation to an exterior surface of pump body 30 and encompasses flushing inlets 40 on pump body 30. Injection mandrel 20 has an injection port 44 fluidly connected to a fluid outlet port 46. Fluid outlet port 46 is in fluid communication with flushing inlets 40 of pump body 30. Injection line 22 has a first end 48 and a second end 50. First end 48 of injection line 22 is fluidly connected to injection port 44 of injection mandrel 20 and second end 50 is fluidly connected to fluid supply 52. A person of skill will understand what types of fluid agents can be used. An annular channel, not shown, is created between pump body 30 and injection mandrel 20 adjacent to flushing inlet 40. Annular channel guides fluid from fluid outlet port 46 of injection mandrel 20 into flushing inlet 40 on pump body 30. A first sealing member 54 and a second sealing member 56 are provided in sealing engagement between pump body 30 and injection mandrel 20 such that a fluid tight seal is created above and below flushing inlets 40.

While it will be understood that flushing inlets 40 may be positioned anywhere on pump body 30, in the embodiment shown, flushing inlets 40 are positioned proximate inlet end 36 of pump body 30. This allows for flushing or treatment fluid to be injected near inlet end 36 of pump body 30 and continue upwards to allow for treatment or flushing of substantially the entire pump body 30.

It will be understood by a person skilled in the art that different well site set ups will be required based upon the type of downhole pump used, the type of wellbore fluid being pumped and the method in which the wellbore fluid is produced.

During a treatment or flushing procedure, injection pump 58 is turned on either manually by well site operators or by a controller, not shown, which automates the procedure. Many controllers are available which could be programmed for this purpose. When a controller is used, a schedule can be created by well site personnel based upon well site procedure or specific requirements of individual wellbores 12. This can include utilizing different types of fluid agents at different intervals or creating a specific schedule for fluid injection. The controller can also cause injection pump 58 to inject fluids after seizure of downhole pump 16. Injection pump 58 pumps flushing or treatment fluid such as a liquid or a foam from fluid supply 52 through injection line 22 and injection mandrel 20 directly into downhole pump 16 through flushing inlets 40. When pump 16 is seized, the fluid agent can be continually pumped down into pump 16 until the accumulation of sand or other detritus material has been cleared. The fluid agent will carry away the accumulated material as it travels through flushing inlets 40 and continues through downhole pump 16 and up production tubing 18. Once sufficient accumulation has been removed, downhole pump 16 will be able to be run again and production of the well 12 can continue. In the event downhole pump 16 becomes gas locked, injection of fluids directly into pump 16 can help work pump 16 through the gas lock and restore pump 16 to its normal operating condition. In addition to batch injection of fluids into downhole pump 16, injection pump 58 may be run on a continuous basis to continuously pump fluid from fluid supply 52 through injection line 22 and injection mandrel 20 directly into downhole pump 16. The amount of fluid being continually pumped through injection line 22 into downhole pump 16 may be determined by well site personnel and include anywhere from 0 liters per day to 500 liters per day to 20 barrels per day. In some cases, it may be beneficial to use only a small amount of fluid, such as 2 liters per day of production fluid or other lubricating fluid, to help keep pump 16 well lubricated. In other cases, large quantities of fluid may be pumped through injection line 22 into downhole pump 16 to help prevent potential issues related to gas lock or pumping off. The determination of the best plan for injection of fluid will be based upon the individual well 12. In pumps 16 that are prone to gas lock or pumping off, continuous injection of fluid may be beneficial. In wells 12 where pump 16 is prone to pumping up slugs of sand, batch injection of fluids may be beneficial. The amount of fluid injected into pump 16 and the plan for a well 12 can be determined based upon user preference.

When a controller, not shown, is used, it can be set up to use power from a battery back-up, not shown, for turning injection pump 58 on in the event of a power failure. A person of skill will understand that a battery back-up is defined as any device known in the art capable of providing electrical power to injection pump 58 during a loss of power to pump jack 28. When pump jack 28 stops due to a loss of power, fluids within downhole pump 16 cannot be pumped out. This often results in sand and other detritus material settling out of the fluid and accumulating within downhole pump 16. In order to prevent this accumulation and the potentially damaging effects, injection pump 58 may be turned on utilizing power from the battery back-up and can pump fluids down injection line 22 and into pump 16. The type of fluid agent injected can include clean flushing fluid that can push the wellbore fluid upwards out of pump 16. The fluid agent may also be a treatment fluid used to help keep the sand and other detritus materials in suspension within the wellbore fluid or to dissolve accumulations and return them to suspension within the wellbore fluid.

Preferred Embodiment of the Downhole Pump Flushing System:

A preferred embodiment of the downhole pump flushing system, generally identified by reference numeral 100, will now be described with reference to FIG. 2 through FIG. 5 and FIG. 8.

Figure 2:
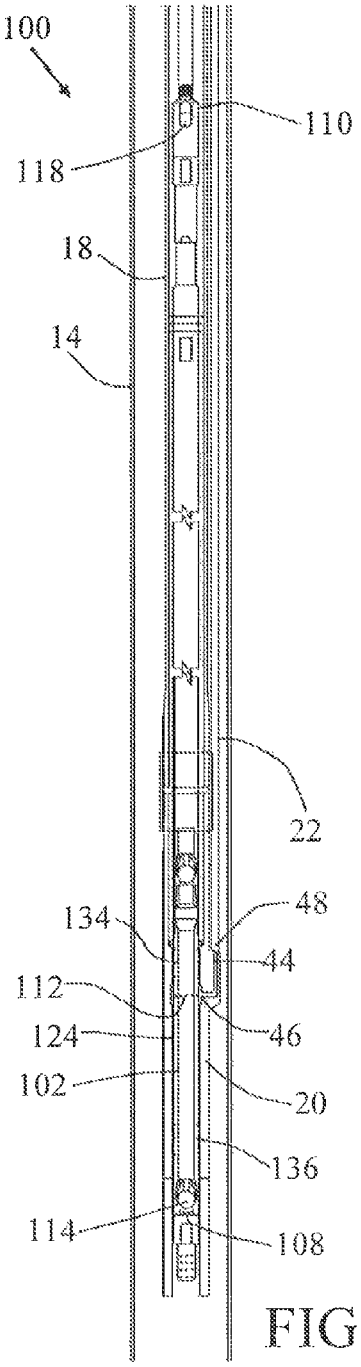
FIG. 2 is a side elevation view, partially in section, of a downhole pump flushing system.
Figure 5:
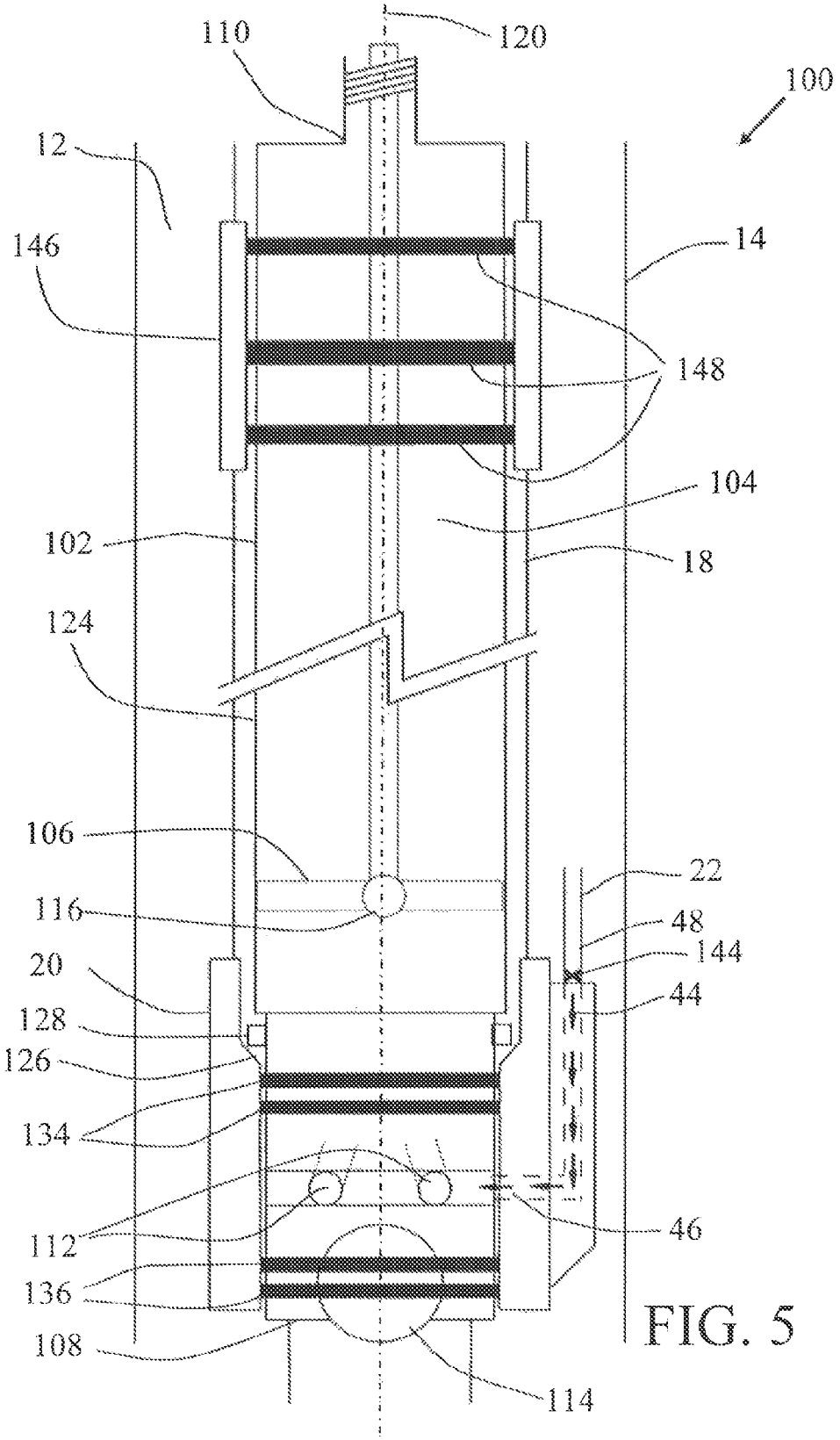
FIG. 5 is a side elevation view, in section, of the downhole pump flushing system.

Referring to FIG. 5, the downhole pump flushing system 100 has a pump barrel 102 defining an interior cavity 104 and a plunger 106 positioned within interior cavity 104 of pump barrel 102 for facilitating lifting of wellbore fluid. Referring to FIG. 2, pump barrel 102 has an inlet end 108, an outlet end 110 and flushing inlets 112. Inlet end 108 has a standing check valve 114 that allows fluid to enter pump barrel 102. Referring to FIG. 5, plunger 106 is movable within pump barrel 102 from inlet end 108 to outlet end 110 to create an upstroke and from outlet end 110 to inlet end 108 to create a downstroke. Plunger 106 has a traveling check valve 116 that allows fluid to pass through plunger 106 from inlet end 108 of pump barrel 102 to outlet end 110 of pump barrel 102. Referring to FIG. 2, outlet end 110 of pump barrel 102 has an upper check valve 118 that prevents the re-entry of fluid into pump barrel 102 after it has been expelled. A person of skill will understand that upper check valve 118 is not required for downhole pump flushing system 100 to work, however upper check valve 118 improves efficiency of downhole pump since plunger 106, shown in FIG. 5, does not have to continuously pump previously pumped fluids that re-enter pump barrel 102 during downstroke.

Referring to FIG. 5, flushing inlets 112 are positioned proximate inlet end 108 of pump barrel 102 above standing check valve 114 and are in parallel spaced relation with each other and perpendicular to a longitudinal axis 120 of pump barrel 102. By positioning flushing inlets 112 at inlet end 108 of pump barrel 102, fluid can be directed to the location in pump barrel 102 most likely to have accumulations of sand or other detritus material. In addition, fluid injected into pump barrel 102 will travel the entire length of pump barrel 102 from inlet end 108 to outlet end 110, allowing for substantially the entire pump barrel 102 to be treated by fluid injected through flushing inlets 112. However, it will be understood by a person skilled in the art that flushing inlets 112 may be positioned in different locations on pump barrel 102. The number of flushing inlets 112, their size and their locations on pump barrel 102 may be customized depending upon the downhole environment, the required injection rates and user preference. Referring to FIG. 5, flushing inlets 112 are angled upwards towards outlet end 110 of pump barrel 102. This creates a jetting action which may be beneficial in breaking up any accumulations of sand or other detritus material that may clog up and ultimately seize plunger 106 within pump barrel 102.

Figure 3:
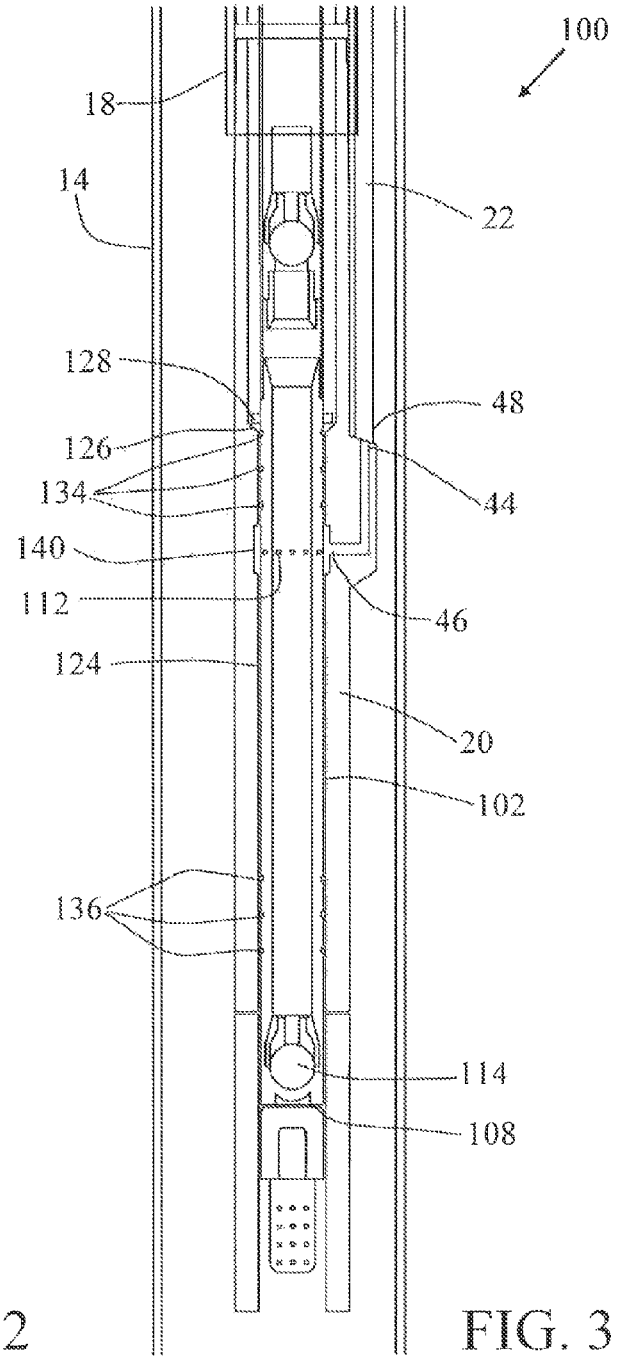
FIG. 3 is an enlarged side elevation view, partially in section, of the downhole pump flushing system shown in FIG. 2.
Figure 4:
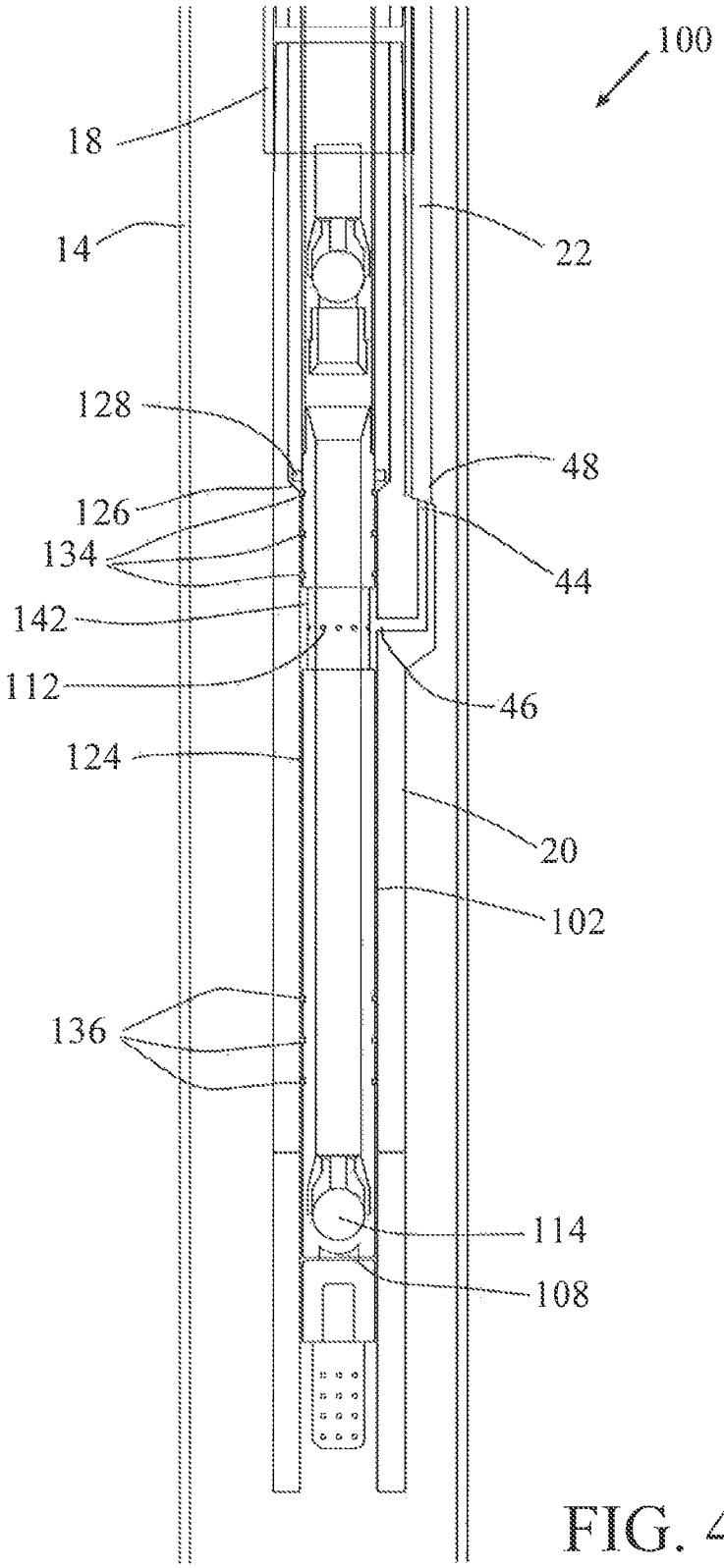
FIG. 4 is a side elevation view, partially in section, of the downhole pump flushing system.

Referring to FIG. 3 and FIG. 4, an injection mandrel 20 is provided in circumferentially engaging relation to an exterior surface 124 of pump barrel 102 and encompasses flushing inlets 112. Injection mandrel 20 has an engagement member 126 that corresponds to a stop 128 positioned on exterior surface 124 of pump barrel 102 for properly positioning pump barrel 102 within injection mandrel 20. A person of skill will understand that stop 128 may be positioned elsewhere on pump barrel 102 and that it may be used in conjunction with different completion components that have corresponding engagement members. For example, while not shown, stop 128 could be positioned near outlet end 110 of pump barrel 102 to engage an engagement member on a pump seat nipple 146, shown in FIG. 5. In the embodiment shown, engagement member 126 is an engagement shoulder, however it will be understood by a person skilled in the art that different types of engagement members 126 may be used. Injection mandrel 20 has an injection port 44 fluidly connected to a fluid outlet port 46. Fluid outlet port 46 is in fluid communication with flushing inlets 112 of pump barrel 102. An injection line 22 has a first end 48 and a second end 50, shown in FIG. 1. First end 48 of injection line 22 is fluidly connected to injection port 44 of injection mandrel 20. Second end 50 of injection line 22 is fluidly connected to fluid supply 52, shown in FIG. 1. A first sealing member 134 is positioned above flushing inlets 112 in sealing engagement between pump barrel 102 and injection mandrel 20. A second sealing member 136 is provided below the flushing inlets 112 in sealing engagement between pump barrel 102 and injection mandrel 20. This creates a fluid tight seal around flushing inlets 112 and causes the fluids injected through injection line 22 and injection mandrel 20 to be guided into the flushing inlets 112. The positioning of first sealing member 134 and second sealing member 136 may be altered to allow for a greater or smaller distance between them. It is important to note that first sealing member 134 and second sealing member 136 are not required to be equidistant from flushing inlets 112. Referring to FIG. 2 through FIG. 4, it can be seen that three first sealing members 134 and three second sealing member 136 are used to create the fluid tight seal. Providing additional sealing members 134 and 136 creates a redundancy that helps to prevent leakage of fluid that is injected from the injection line 22 into the wellbore. Referring to FIG. 5, two of each of sealing members 134 and 136 are used to create a fluid tight seal.

Figure 8:
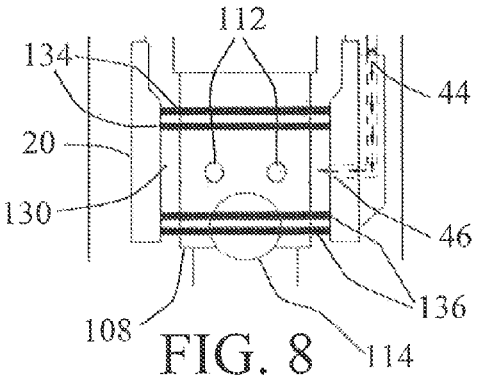
FIG. 8 is an enlarged side elevation view, partially in section, of the injection mandrel and inlet end of the pump barrel with oversized sealing members.

A person of skill will understand that in order for injection mandrel 20 to be positioned in circumferentially engaging relation to pump barrel 102, there must be a minimum clearance that allows for placement of pump barrel 102 into position within injection mandrel 20. In addition to the minimum clearance required for fitting pump barrel 102 within injection mandrel 20, a channel 130 should be created around and adjacent flushing inlets 112. Channel 130 guides fluid from fluid outlet port 46 of injection mandrel 20 into fluid inlets 112. Channel 130 allows for greater injection rates since there is a greater area through which the fluid exiting the fluid outlet port 46 can enter. It may also provide more uniform injection into interior cavity 104 as the fluid has more space to flow around pump barrel 102 and into the flushing inlets 112. If only the minimum clearance required for fitting pump barrel 102 within injection mandrel 20 is used, the amount of pressure that would be required to obtain acceptable injection rates would be extreme and in most cases it would be impossible to obtain an acceptable injection rate due to the small space through which the flushing fluid would be forced to flow from fluid outlet port 46 to flushing inlets 112. Referring to FIG. 3, channel 130 may be obtained by creating an injection mandrel port cut out 140 in injection mandrel 20. Injection mandrel port cut out 140 is a notch machined out of injection mandrel 20 to create channel 130 around flushing inlets 112. Referring to FIG. 4, the additional clearance may also be obtained by creating a pump injection port cut out 142 in the pump barrel 102. Pump injection port cut out 142 is a narrowing of pump barrel 102 in the area of flushing inlets 112 to create channel 130 around flushing inlets 112. Referring to FIG. 8, the use of oversized first sealing members 134 and second sealing members 136 to allow for increased space between injection mandrel 22 and pump barrel 102 may also be used to create channel 130.

Referring to FIG. 5, an injection check valve 144 is provided to prevent wellbore fluid from traveling upwards through injection line 22. It will be understood by a person skilled in the art that as long as flushing or treatment fluid remains in injection line 22, it is unlikely that wellbore fluid would be able to enter it. However, injection line leakages could provide the opportunity for wellbore fluid to travel upwards as injection line 22 leaks out the flushing or treatment fluid that normally flows through it. Injection check valve 144 can be positioned in many different places, however the purpose remains the same. Injection check valve 144 permits fluid to flow towards injection port 44 of injection mandrel 20 while preventing back flow of fluid. Damage occurring below injection check valve 144 may allow wellbore fluid to travel from interior cavity 104 of pump barrel 102, through injection mandrel 20, up into injection line 22 and out into wellbore 12 between casing 14 and production tubing 18. By placing injection check valve 144 adjacent first end 48 of injection line 22, it becomes less likely that a breakage will occur below injection check valve 144. In addition to injection check valve 144 positioned within injection line 22, or in the alternative, a second injection check valve, not shown, may be positioned within injection port 44 or fluid outlet port 46 of the injection mandrel 20 such that it permits fluid to flow through injection mandrel 20 into flushing inlets 112.

Referring to FIG. 5, a pump seat nipple 146 with sealing members 148 is included within the production tubing 18 to help prevent sand and detritus material from accumulating in the space between pump barrel 102 and production tubing 18. A person of skill will understand that additional completion components may be included within production tubing 18 as required by downhole conditions and well site personnel.

Installation of the Downhole Pump Flushing System:

The installation of the downhole pump flushing system 100 into a wellbore 12 will be described, with reference to FIG. 5 through FIG. 7. It will be understood by a person skilled in the art that various steps will be applicable to the installation of the system as associated with other types of pumps such as progressive cavity pumps or electric submersible pumps. It will be understood by persons skilled in the art that different methods or techniques used during the installation process may also be used.

Figure 6:
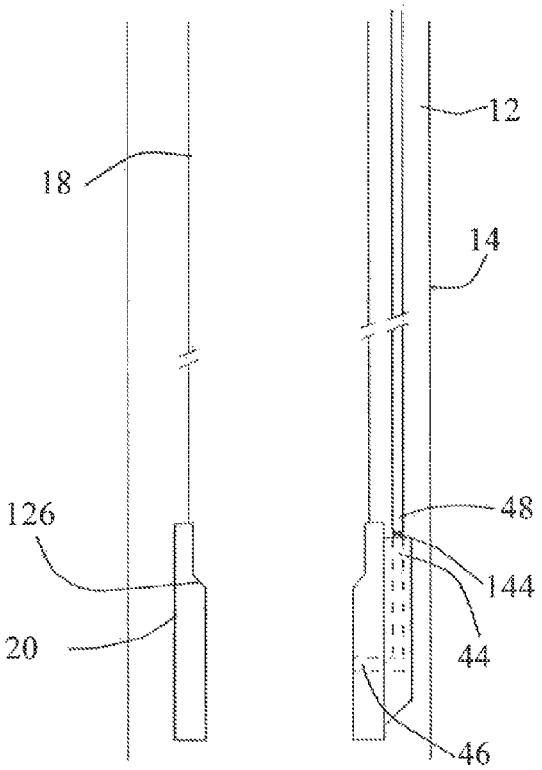
FIG. 6 is a side elevation view, partially in section, of production tubing and an injection mandrel deployed downhole.
Figure 7:
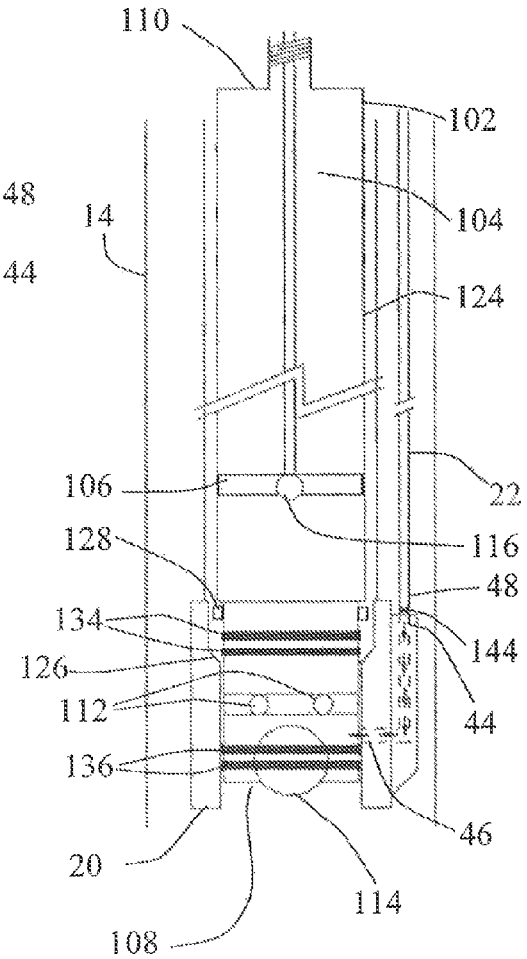
FIG. 7 is a side elevation view, partially in section, of the pump body being deployed downhole.

Referring to FIG. 6, injection mandrel 20 is run into wellbore 12 with production tubing 18. Injection port 44 of injection mandrel 20 is connected to first end 48 of injection line 22. The diameter of injection line 22 that is used will be determined by several different factors including the casing diameter, production tubing diameter and the preferred injection rate. The smaller the diameter of injection line 22, the lower the injection rate will be. Injection line 22 is run into wellbore 12 in conjunction with injection mandrel 20 and production tubing 18. Once injection mandrel 20 is in the proper location, production tubing and/or injection mandrel can be anchored in place using anchors 24, shown in FIG. 1, or other conventional methods. The positioning of injection mandrel 20 is based upon the preferred location of the pump and should, therefore, be positioned accordingly. A person of skill will be able to determine an appropriate location for the pump based upon their knowledge and the specific requirements of each wellbore 12. In an attempt to avoid large quantities of sand, it is common practice to position the pump further uphole then what would be considered an "ideal" location for the pump. Because this system is capable of flushing the interior cavity 104 of accumulations of sand and other detritus material, it may be possible to position the pump barrel 102 further downhole closer to the "ideal" position. Referring to FIG. 5, in the embodiment of the system described, injection mandrel 20 should be positioned at a location downhole that allows the user to position inlet end 108 of the pump barrel 102 in the preferred location for the particular wellbore 12. A person of skill will understand that the location of inlet end 108 of pump barrel 102 will be different for each wellbore 12 based upon the downhole environment and other factors. After positioning of injection mandrel 20, second end 50, shown in FIG. 1, of injection line 22 is connected to a nitrogen supply and nitrogen is pumped down injection line 22 to check for damage to injection line 22 caused during deployment. Nitrogen is used as it is an inert gas, however, it will be understood by a person skilled in the art that other fluids could also be used for this purpose. Injection check valve 144, which is located at first end 48 of injection line 22 or within injection port 44 or fluid outlet port 46 of injection mandrel 20, may be designed to open only under predetermined pressures. For example, injection check valve 144 may be designed to open when the pressure at injection check valve 144 is 500 psi. Successful opening of injection check valve 144 using nitrogen under pressure is an indication that injection line 22 is undamaged. At this point, the next step may be taken. However, if there appears to be damage to injection line 22, it will be necessary to remove production tubing 18, injection mandrel 20 and injection line 22 and redeploy with an undamaged injection line 22.

Once injection mandrel is set 20, production tubing 18 is flushed with two times its capacity to remove any sand or detritus material that may be present. Referring to FIG. 7, after flushing of production tubing 18, pump barrel 102 is run down into production tubing 18 towards injection mandrel 20. Pump barrel 102 is set on injection mandrel 20 and is then pulled upwards so that first sealing member 134 is above injection mandrel 20 but second sealing member 136 stays below fluid outlet port 46 of injection mandrel 20. First sealing member 134 seals below fluid outlet port 46 to prevent fluid from flowing downhole. With second sealing member 136 above injection mandrel 20, fluid pumped down injection line 22 begins to fill production tubing 18 upwards. This provides a further mechanism to help to ensure that production tubing 18 is clean prior to the setting of pump barrel 102. Any sand or detritus material left within production tubing 18 after the setting of pump barrel 102 can cause early wearing or damage. This step also provides the opportunity to test and calculate injection rates since the volume of fluid required to fill production tubing 18 is known or may be easily calculated using the diameter and length of tubing 18. Referring to FIG. 5, while injection through injection line 22 continues, pump barrel 102 is dropped into place. First stop 126 on injection mandrel 20 and second stop 128 on pump barrel 102 provide means for properly seating pump barrel 102 in injection mandrel 20 and prevent damage to injection mandrel 20 caused by excess force when pump barrel 102 is pushed into position. Once pump barrel 102 has been seated in injection mandrel 20, a measureable pressure change should occurs that indicates that pump barrel 102 has been placed properly. The fluid being pumped down injection line 22 should now be flowing into interior cavity 104 of pump barrel 102. The injection rates can be further tested at this time. Once pump barrel 102 is set in injection mandrel 20, additional fluid is pumped down production tubing 18 to completely fill production tubing 18. Plunger 106 is then manually stroked up and down several times to ensure that everything is working properly. Manually stroking plunger 106 will cause an increase in pressure within the pump. When everything is determined to be in working order, the pump is ready for use. Fluid can then be pumped down injection line 22 to continue pressuring up the pump prior to use.

Any use herein of any terms describing an interaction between elements is not meant to limit the interaction to direct interaction between the subject elements, and may also include indirect interaction between the elements such as through secondary or intermediary structure unless specifically stated otherwise.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent that changes may be made to the illustrative embodiments, while falling within the scope of the invention. As such, the scope of the following claims should not be limited by the preferred embodiments set forth in the examples and drawings described above, but should be given the broadest interpretation consistent with the description as a whole.

What is claimed is:

1. A downhole pump flushing system comprising:

a pump body defining an interior cavity, the pump body having an inlet end, an outlet end and at least one flushing inlet, the inlet end having a standing check valve that allows fluid to enter the pump body;

a lifting member positioned within the interior cavity of the pump body for facilitating lifting of wellbore fluid;

an injection mandrel, extending from a production tube, is in circumferentially engaging relation to an exterior surface of the pump body such that the injection mandrel encompasses the at least one flushing inlet, the injection mandrel having an injection port fluidly connected to a fluid outlet port, the fluid outlet port being in fluid communication with the at least one flushing inlet of the pump body;

an injection line having a first end and a second end, the first end of the injection line being fluidly connected to the injection port of the injection mandrel and the second end being fluidly connected to a fluid supply;

an annular channel between the pump body and the injection mandrel adjacent to the at least one flushing inlet such that fluid is guided into the at least one flushing inlet from the fluid outlet port of the injection mandrel; and a first sealing member and a second sealing member in sealing engagement between the pump body and the injection mandrel such that a fluid tight seal is created above and below the at least one flushing inlet.

2. The downhole pump flushing system of claim 1 wherein the at least one flushing inlet is positioned proximate the inlet end of the pump body.

3. The downhole pump flushing system of claim 1 wherein the at least one flushing inlet is angled towards the outlet end of the pump body.

4. The downhole pump flushing system of claim 1 wherein the at least one flushing inlet comprises a plurality of flushing inlet are positioned in parallel spaced relation perpendicular to a longitudinal axis of the pump body.

5. The downhole pump flushing system of claim 1 wherein an injection check valve is positioned within the injection line such that fluid is permitted to flow towards the first end of the injection line.

6. The downhole pump flushing system of claim 5 wherein the injection check valve is positioned within the injection line adjacent to the first end of the injection line.

7. The downhole pump flushing system of claim 1 wherein a second injection check valve is positioned within the injection port or the fluid outlet port of the injection mandrel such that fluid is permitted to flow through the injection mandrel into the at least one flushing inlet.

8. The downhole pump flushing system of claim 1 wherein the pump body is a pump barrel and the lifting member is a plunger, the plunger being movable within the pump barrel from the inlet end to the outlet end to create an upstroke and from the outlet end to the inlet end to create a downstroke, the plunger having a traveling check valve that allows fluid to pass through the plunger from the inlet end of the pump barrel to the outlet end of the pump barrel.

9. The downhole pump flushing system of claim 1 wherein the outlet end has an upper check valve that prevents fluid from re-entering the pump body after it has been expelled.

10. A downhole pump flushing system comprising:

a pump barrel defining an interior cavity, the pump barrel having an inlet end, an outlet end and at least one flushing inlet, the inlet end having a standing check valve that allows fluid to enter the pump barrel;

a plunger positioned within the interior cavity of the pump barrel for facilitating lifting of wellbore fluid, the plunger being movable within the pump barrel from the inlet end to the outlet end to create an upstroke and from the outlet end to the inlet end to create a downstroke, the plunger having a traveling check valve that allows fluid to pass through the plunger from the inlet end of the pump barrel to the outlet end of the pump barrel;

an injection mandrel, extending from a production tube, is in circumferentially engaging relation to an exterior surface of the pump barrel such that the injection mandrel encompasses the at least one flushing inlet, the injection mandrel having an injection port fluidly connected to a fluid outlet port, the fluid outlet port being in fluid communication with the at least one flushing inlet of the pump barrel;

an injection line having a first end and a second end, the first end of the injection line being fluidly connected to the injection port of the injection mandrel and the second end being fluidly connected to a fluid supply;

an annular channel between the pump body and the injection mandrel adjacent to the at least one flushing inlet such that fluid is guided into the at least one flushing inlet from the fluid outlet port of the injection mandrel; and a first sealing member and a second sealing member in sealing engagement between the pump barrel and the injection mandrel such that a fluid tight seal is created above and below the at least one flushing inlet.

11. The downhole pump flushing system of claim 10 wherein the at least one flushing inlet is positioned proximate the inlet end of the pump barrel above the standing check valve.

12. The downhole pump flushing system of claim 10 wherein the at least one flushing inlet is angled towards the outlet end of the pump barrel.

13. The downhole pump flushing system of claim 10 wherein the at least one flushing inlet comprises a plurality of flushing inlets that are positioned in parallel spaced relation perpendicular to a longitudinal axis of the pump barrel.

14. The downhole pump flushing system of claim 10 wherein an injection check valve is positioned within the injection line such that fluid is permitted to flow towards the first end of the injection line.

15. The downhole pump flushing system of claim 14 wherein the injection check valve is positioned within the injection line adjacent to the first end of the injection line.

16. The downhole pump flushing system of claim 10 wherein a second injection check valve is positioned within the injection port or the fluid outlet port of the injection mandrel such that fluid is permitted to flow through the injection mandrel into the at least one flushing inlet.

17. The downhole pump flushing system of claim 10 wherein the injection mandrel having an engagement member that corresponds to a stop on the exterior surface of the pump barrel for positioning of the pump barrel within the injection mandrel.

18. The downhole pump flushing system of claim 17 wherein the engagement member is an engagement shoulder.

19. The downhole pump flushing system of claim 10 wherein the outlet end of the pump barrel has an upper check valve such that it prevents fluid from re-entering the pump barrel after it has been expelled.

20. A downhole pump flushing system comprising:

a pump barrel defining an interior cavity, the pump barrel having an inlet end, an outlet end and at least one flushing inlet positioned proximate the inlet end of the pump barrel, the inlet end having a standing check valve that allows fluid to enter the pump barrel;

a plunger positioned within the interior cavity of the pump barrel for facilitating lifting of wellbore fluid, the plunger being movable within the pump barrel from the inlet end to the outlet end to create an upstroke and from the outlet end to the inlet end to create a downstroke, the plunger having a traveling check valve that allows fluid to pass through the from the inlet end of the pump barrel to the outlet end of the pump barrel;

an injection mandrel, extending from a production tube, is in circumferentially engaging relation with an exterior surface of the pump barrel such that the injection mandrel encompasses the at least one flushing inlet, the injection mandrel having an injection port fluidly connected to a fluid outlet port, the fluid outlet port being in fluid communication with the at least one flushing inlet of the pump barrel, the injection mandrel having a first stop corresponding to a second stop on the exterior surface of the pump barrel for placement of the pump barrel within the injection mandrel;

an injection line having a first end and a second end, the first end of the injection line being fluidly connected to the injection port of the injection mandrel and the second end being fluidly connected to a fluid supply, an injection check valve being positioned at the first end of the injection line such that fluid is permitted to flow to the injection port of the injection mandrel;

an annular channel between the pump body and the injection mandrel adjacent to the at least one flushing inlet such that fluid is guided into the at least one flushing inlet from the fluid outlet port of the injection mandrel; and a first sealing member and a second sealing member in sealing engagement between the pump barrel and the injection mandrel such that a fluid tight seal is created above and below the at least one flushing inlet.

21. The downhole pump flushing system of claim 20 wherein the at least one flushing inlet is angled towards the outlet end of the pump barrel.

22. The downhole pump flushing system of claim 20 wherein the at least one flushing inlet comprises a plurality of flushing inlets that are positioned in parallel spaced relation perpendicular to a longitudinal axis of the pump barrel.

23. The downhole pump flushing system of claim 20 wherein a second injection check valve is positioned within the injection port or the fluid outlet port of the injection mandrel such that fluid is permitted to flow through the injection mandrel into the at least one flushing inlet.

24. The downhole pump flushing system of claim 20 wherein the first stop is an engagement shoulder.

25. The downhole pump flushing system of claim 20 wherein the outlet end of the pump barrel has an upper check valve such that it prevents fluid from re-entering the pump barrel after it has been expelled.

26. A method of flushing a downhole pump comprising the steps of:

providing a pump having a pump body defining an interior cavity, the pump body having an inlet end, an outlet end and at least one flushing inlet, a lifting member positioned within the interior cavity of the pump body for facilitating lifting of wellbore fluid, an injection mandrel, extending from a production tube, is in circumferentially engaging relation to an exterior surface of the pump body such that the injection mandrel encompasses the at least one flushing inlet, the injection mandrel having an injection port fluidly connected to a fluid outlet port, the fluid outlet port being in fluid communication with the at least one flushing inlet of the pump body, an injection line having a first end and a second end, the first end of the injection line being fluidly connected to the injection port of the injection mandrel and the second end being fluidly connected to a fluid supply, an annular channel between the pump body and the injection mandrel adjacent to the at least one flushing inlet such that fluid is guided into the at least one flushing inlet from the fluid outlet port of the injection mandrel and a first sealing member and a second sealing member in sealing engagement between the pump body and the injection mandrel such that a fluid tight seal is created above and below the at least one flushing inlet;

providing an injection pump for pumping fluids from the fluid supply through the injection line;

injecting a fluid agent into the second end of the injection line such that it travels through the injection line and injection mandrel directly into the pump body through the at least one flushing inlet.

27. The method of claim 26 wherein the fluid agent is injected directly into the pump body proximate to the inlet end.

28. The method of claim 26 wherein the injection of the fluid agent occurs continuously.

29. The method of claim 26 wherein the injection of the fluid agent occurs based upon a predetermined schedule.

30. The method of claim 26 wherein the injection of the fluid agent occurs after seizure of the lifting member within the pump body.

31. The method of claim 26 further comprising the steps of:

providing a controller and a battery back-up connected to the injection pump such that the controller provides on and off signals to the injection pump;

sending a signal from the controller to the injection pump to turn on utilizing power from the battery back-up in the event of a power failure;

injecting the fluid agent into the second end of the injection line such that it travels through the injection line and injection mandrel directly into the pump body through the at least one flushing inlet.

32. The method of claim 26 wherein the fluid agent is a liquid.

33. The method of claim 26 wherein the fluid agent is a foam.

34. A method of flushing a downhole pump comprising the steps of:

providing a pump having pump barrel defining an interior cavity, the pump barrel having an inlet end, an outlet end and at least one flushing inlet positioned proximate the inlet end of the pump barrel, the inlet end having a standing check valve that allows fluid to enter the pump barrel, a plunger positioned within the interior cavity of the pump barrel for facilitating lifting of wellbore fluid, the plunger being movable within the pump barrel from the inlet end to the outlet end to create an upstroke and from the outlet end to the inlet end to create a downstroke, the plunger having a traveling check valve that allows fluid to pass through the plunger from the inlet end of the pump barrel to the outlet end of the pump barrel, an injection mandrel, extending from a production tube, is in circumferentially engaging relation with an exterior surface of the pump barrel such that the injection mandrel encompasses the at least one flushing inlet, the injection mandrel having an injection port fluidly connected to a fluid outlet port, the fluid outlet port being in fluid communication with the at least one flushing inlet of the pump barrel, the injection mandrel having a first stop corresponding to a second stop on the exterior surface of the pump barrel for proper placement of the pump barrel within the injection mandrel, an injection line having a first end and a second end, the first end of the injection line being fluidly connected to the injection port of the injection mandrel and the second end being fluidly connected to a fluid supply, an injection check valve being positioned at the first end of the injection line such that fluid is permitted to flow to the injection port of the injection mandrel, an annular channel between the pump body and the injection mandrel adjacent to the at least one flushing inlet such that fluid is guided into the at least one flushing inlet from the fluid outlet port of the injection mandrel and a first sealing member and a second sealing member in sealing engagement between the pump barrel and the injection mandrel such that a fluid tight seal is created above and below the at least one flushing inlet;

providing an injection pump for pumping fluids from the fluid supply through the injection line;

injecting a fluid agent into the second end of the injection line such that the fluid agent travels through the injection line and injection mandrel directly into the pump barrel through the at least one flushing inlet.

35. The method of claim 34 wherein the injection of the fluid agent occurs continuously.

36. The method of claim 34 wherein the injection of the fluid agent occurs based upon a predetermined schedule.

37. The method of claim 34 wherein the injection of the fluid agent occurs after seizure of the plunger within the pump barrel.

38. The method of claim 34 further comprising the steps of:

providing a controller and a battery back-up connected to the injection pump such that the controller provides on and off signals to the injection pump;

sending a signal from the controller to the injection pump to turn on utilizing power from the battery back-up in the event of a power failure;

injecting the fluid agent into the second end of the injection line such that it travels through the injection line and injection mandrel directly into the pump barrel through the at least one flushing inlet.

39. The method of claim 34 wherein the fluid agent is a liquid.

40. The method of claim 34 wherein the fluid agent is a foam.

* * * * *